US012017879B2

(12) United States Patent
Lin et al.

(10) Patent No.: US 12,017,879 B2
(45) Date of Patent: Jun. 25, 2024

(54) PAPER BLOCKING DEVICE

(71) Applicant: Foxlink Image Technology Co., Ltd., New Taipei (TW)

(72) Inventors: Wei Fong Lin, New Taipei (TW); Yuan Yi Lin, New Taipei (TW); Sheng Kai Lin, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 332 days.

(21) Appl. No.: 17/569,317

(22) Filed: Jan. 5, 2022

(65) Prior Publication Data

US 2023/0060751 A1 Mar. 2, 2023

(30) Foreign Application Priority Data

Aug. 25, 2021 (CN) ..... 202122021494.X

(51) Int. Cl.
*B65H 3/06* (2006.01)
*B65H 3/66* (2006.01)

(52) U.S. Cl.
CPC ..... *B65H 3/0669* (2013.01); *B65H 3/66* (2013.01); *B65H 2403/51* (2013.01); *B65H 2403/732* (2013.01)

(58) Field of Classification Search
CPC . B65H 3/66; B65H 3/063; B65H 3/56; B65H 3/52; B65H 3/54
See application file for complete search history.

(56) References Cited

U.S. PATENT DOCUMENTS 9,592,974 B2 * 3/2017 Saito ..... B65H 3/0669
2010/0270732 A1 * 10/2010 Huang ..... B65H 3/565 271/18

* cited by examiner

*Primary Examiner* — Howard J Sanders
(74) *Attorney, Agent, or Firm* — Lin & Associates Intellectual Property, Inc.

(57) ABSTRACT

A paper blocking device includes a pick roller, a cover plate, a paper blocking component, a driving mechanism, a gear mechanism and a motor. The cover plate has a pick roller window penetrated the cover plate. The pick roller is positioned in the pick roller window. The paper blocking component is coupled to the cover plate. The driving mechanism has a driving shaft and a cam being connected to the driving shaft. The cam is connected to the paper blocking component. The gear mechanism is connected to the driving shaft. The motor is connected to the gear mechanism. As described above, the paper blocking device can block papers and align the leading edges of papers.

11 Claims, 3 Drawing Sheets

PAPER BLOCKING DEVICE

CROSS-REFERENCE TO RELATED APPLICATION

The present application is based on, and claims priority from, China Patent Application No. 202122021494.X, filed Aug. 25, 2021, the disclosure of which is hereby incorporated by reference herein in its entirety.

BACKGROUND OF THE INVENTION

1. Field of the Invention

The present invention generally relates to a paper blocking device, and more particularly to a paper blocking device for a portable scanner.

2. The Related Art

A conventional image forming apparatus particularly to a portable scanner merely cannot be provided with a paper blocking device due to small bulk. An incorrect feeding sequence is caused because leading edges of papers simultaneously contact with a pick roller in feeding process. In order to avoid the incorrect feeding sequence, user need to stack papers sequentially and align the leading edges of the stack papers manually. As a result, the pick roller only contacts with the lowest paper to feed the papers in correct sequence. Therefore, it is necessary to provide an innovative paper blocking device used in an image forming apparatus, and the paper blocking device is capable of blocking the leading edges of papers to ensure the leading edges of papers are aligned. Therefore the portable scanner with the blocking device is convenient to user.

SUMMARY OF THE INVENTION

An object of the present invention is to provide a paper blocking device. The paper blocking device includes a pick roller, a cover plate, a paper blocking component, a driving mechanism, a gear mechanism and a motor. The cover plate has a pick roller window penetrated the cover plate. The pick roller is positioned in the pick roller window. The paper blocking component is coupled to the cover plate. One end of the paper blocking component is hinged on the cover plate. The other end of the paper blocking component is located in the pick roller window. The driving mechanism has a driving shaft and a cam. One end of the cam is connected to one end of the driving shaft. The other end of the cam is connected to the one end of the paper blocking component and is positioned under the one end of the paper blocking component. The gear mechanism is connected to the other end of the driving shaft. The motor is connected to the gear mechanism. The other end of the paper blocking component moves above a top surface of pick roller or moves below the top surface of the pick roller by rotation of the cam under drive of the motor, the gear mechanism and the driving shaft.

Another object of the present invention is to provide a paper blocking device. The paper blocking device includes a cover plate, a pick roller, a paper blocking component, a driving mechanism, a gear mechanism and a motor. The cover plate has a pick roller window penetrated through the cover plate. The pick roller is positioned in the pick roller window. The paper blocking component has a linking portion being hinged on the cover plate, and at least one blocking arm being connected to the linking portion and positioned in the pick roller window. The driving mechanism has a driving shaft and a cam. One end of the cam is connected to one end of the driving shaft. The other end of the cam is connected to the blocking arm and is positioned under the blocking arm. The gear mechanism is connected to the other end of the driving shaft. The motor is connected to the gear mechanism. The blocking arm moves above a top surface of pick roller or moves below the top surface of the pick roller by rotation of the cam under drive of the motor, the gear mechanism and the driving shaft.

Another object of the present invention is to provide a paper blocking device. The paper blocking device includes a cover plate, a pick roller, a linking portion, at least one blocking arm, a protrusion, a recess, a cam, a driving shaft, a gear mechanism and a motor. The cover plate has a pick roller window penetrated through the cover plate. The pick roller is positioned in the pick roller window. The linking portion is hinged on the cover plate. The blocking arm is connected to the linking portion and positioned in the pick roller window. The protrusion is extended from the blocking arm and extended toward a top surface of the pick roller. The recess is formed on a bottom surface of the blocking arm. The cam is fitted with the recess. The driving shaft is connected to the cam. The gear mechanism is connected to the driving shaft. The motor is connected to the gear mechanism. The motor drives the cam to rotate by the gear mechanism and the driving shaft. When the cam rotates in the recess, the cam pushes the blocking arm to move toward the top surface of the pick roller, and the protrusion moves above the top surface of pick roller.

With reference to FIG. 4-6, in the preferred embodiment, a torque-limiting mechanism 60 is located between the driving shaft 41 and the gear mechanism 50. The driving shaft 41 and the pick roller shaft 11 are parallel with each other. The torque-limiting mechanism 60 has a driving gear 61, an elastic piece 62, a driving ring 63 and a friction plate 64 which are sleeved on the pick roller axle 11 in order. The elastic piece 62 can be replaced by a compression spring in another embodiment. A connection portion 63*a* is extended from an outer surface of the driving ring 63 and is connected to the other end of the driving shaft 41. The friction plate 64 is circular shape with axle holes in the middle thereof. At least two engaged recesses 64*a* are formed on the friction plate 64. At least two hooks 61*a* corresponding to the engaged recesses 64*a* are located on one end of the driving gear 61 which is facing the elastic piece 62. The hooks 61*a* are passed through the elastic plate 62, the driving ring 63 and the engaged recesses 64*a* of the friction plate 64 in order. The hooks 61*a* are clamped with the engaged recesses 64*a*, so that the elastic piece 62, the driving ring 63 and the friction plate 64 are assembled. The elastic piece 62 is located between the driving gear 61 and the driving ring 63. The elastic plate 62 applies a normal force toward the driving ring 63, so that a friction force is caused between the driving ring 63 and the friction plate 64. The driving ring 63 and the driving gear 61 are rotating synchronously. When a load of the driving ring 63 is higher than the friction force, the driving ring 63 is slipped on the friction plate 64, so that the driving ring 63 and the driving gear 61 are rotating asynchronously to limit the torque.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
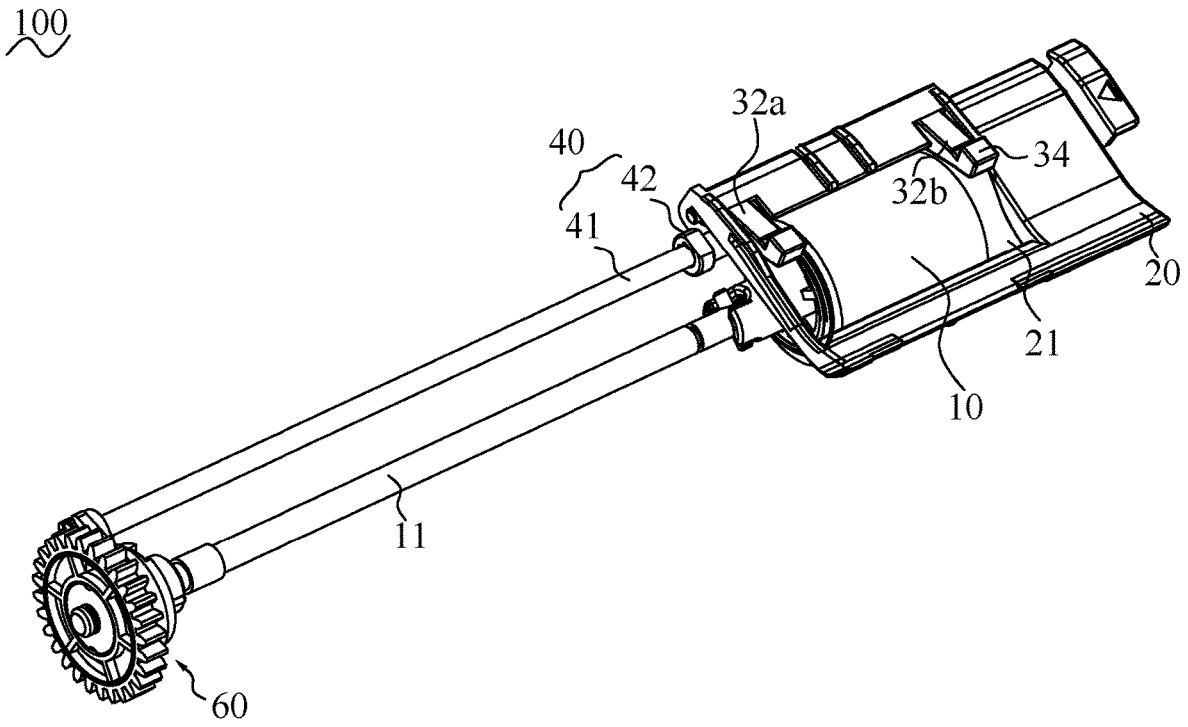
FIG. 1 is a perspective view of a paper blocking device in accordance with a preferred embodiment of the present invention.
Figure 2:
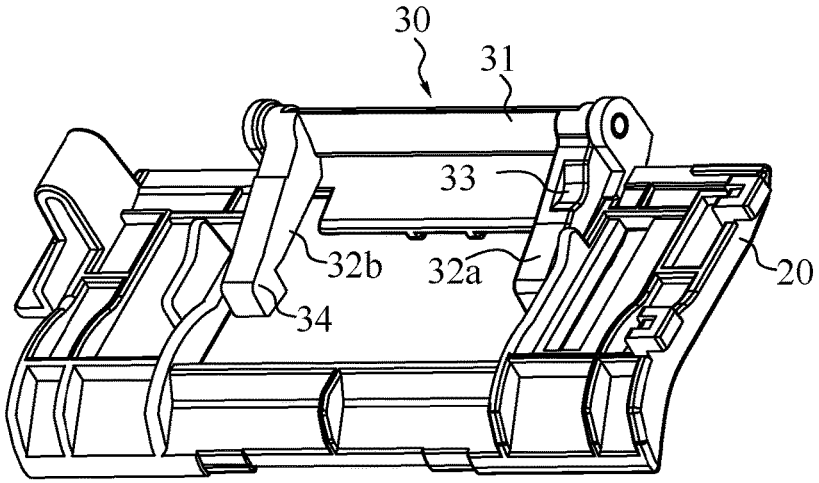
FIG. 2 is a perspective view showing a cover plate hinged on a paper blocking component of the paper blocking device in accordance with the preferred embodiment of the present invention.
Figure 6:
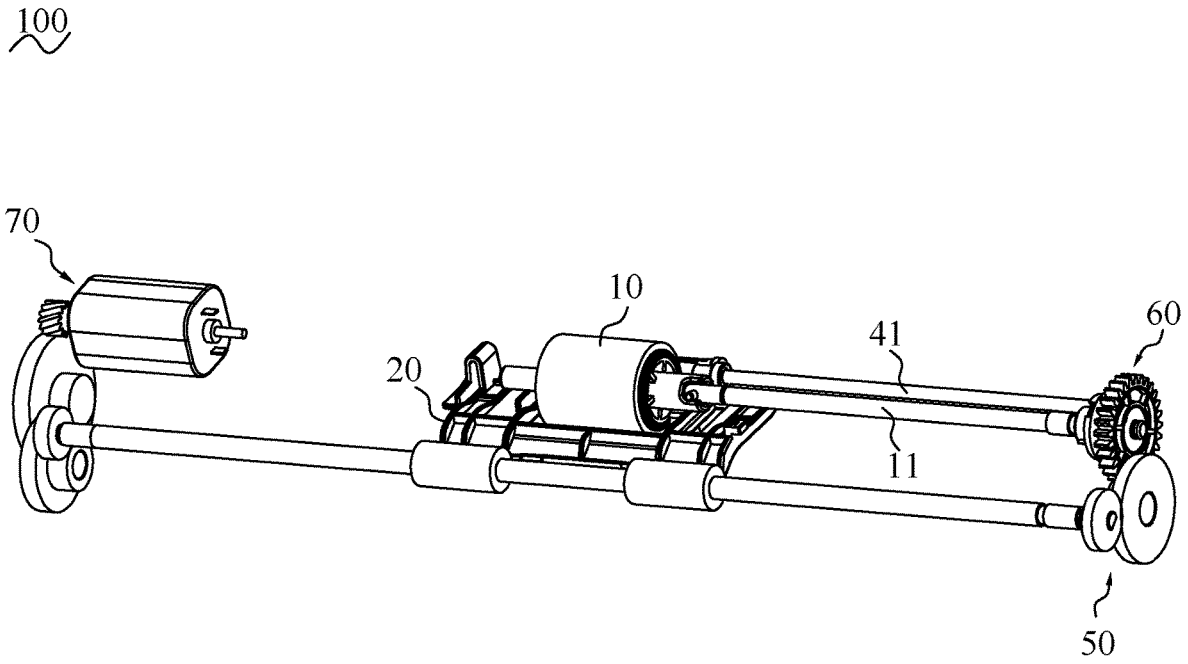
FIG. 6 is a perspective view of a paper blocking device in operation status.

With reference to FIG. 1-2 and FIG. 6, a paper blocking device 100 in accordance with a preferred embodiment of the present invention is shown. The paper blocking device 100 is used in an image forming apparatus such as a portable scanner and a portable printer. In the preferred embodiment, the paper blocking device 100 includes a pick roller 10, a cover plate 20, a paper blocking component 30, a driving mechanism 40, a gear mechanism 50 and a motor 70. The cover plate 20 is formed a pick roller window 21 penetrated a top surface and a bottom surface of the cover plate 20. The pick roller 10 is positioned in the pick roller window 21. A front end of the paper blocking component 30 is hinged with the cover plate 20, and a rear end of the paper blocking component 30 is located in the pick roller window 21. The driving mechanism 40 has a driving shaft 41 and a cam 42. One end of the cam 42 is fixed to one end of the driving axle 41. The other end of the cam 42 is connected to the paper blocking component 30. The gear mechanism 50 is connected to the other end of the driving shaft 41. The gear mechanism 50 is connected to the motor 70.

Figure 3:
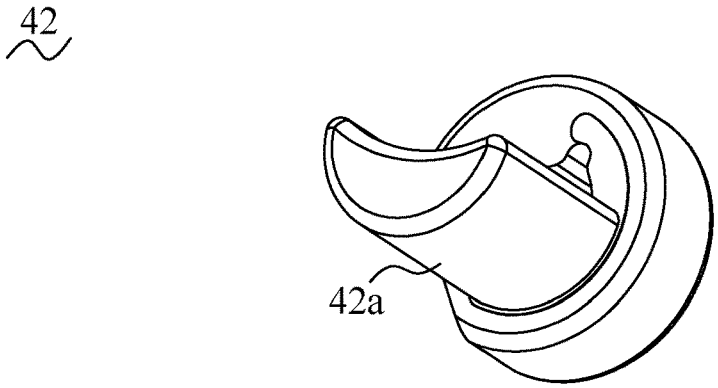
FIG. 3 is a perspective view of a cam of the paper blocking device in accordance with the preferred embodiment of the present invention.

With reference to FIG. 1-3, in the preferred embodiment, the paper blocking component 30 has a linking portion 31 being hinged on the cover plate 20. Two blocking arms 32*a*, 32*b* are located on two sides of the licking portion 31. The blocking arms 32*a*, 32*b* are accommodated in the pick roller window 21. The blocking arms 32*a*, 32*b* are located at two sides of the pick roller 10. One of the blocking arms 32*a*, 32*b* is adjacent to the cam 42 and above the cam 42. The cam 42 has an engaged protrusion 42*a*, the engaged protrusion 42*a* has a crescent shape cross section. The blocking arms 32*a*, 32*b* are moved upward and above the top surface of the pick roller 10 because the engaged protrusion 42*a* of the cam 42 pushes the blocking arms 32*a*. The shape of the cross section of the engaged protrusion 42*a* is not limited to the crescent shape.

In the preferred embodiment, in order to reduce a resistance caused by the cam 42 pushing the blocking arms 32*a* to help that the cam 42 is easy to rotate and easy to push the blocking arms 32*a*, 32*b*, a bottom surface of the one of the blocking arms 32*a*, 32*b* is formed an arc shape recess 33 fitted with the engaged protrusion 42*a*. When the cam 42 is rotated under drive of the driving axle 41, front ends of the blocking arms 32*a*, 32*b* are moved up or moved down along a rotation angle of the cam 42. A protrusion 34 is extended upward from each of rear ends of the blocking arms 32*a*, 32*b*. When the cam 42 is rotated and the engaged protrusion 42*a* of the cam 42 pushes the arc shape recess 33, the blocking arms 32*a*, 32*b* are moved up, so that the protrusion 34 is above the top surface of the pick roller 10 for blocking papers. The pick roller 10 is sleeved on a pick roller shaft 11. The pick roller shaft 11 is connected to the motor by the gear mechanism 50. When the cam 42 is further rotated and the engaged protrusion 42*a* of the cam 42 leaves the arc shape recess 33, the blocking arms 32*a*, 32*b* are moved down, so that the protrusion 34 is below the top surface of the pick roller 10 for feeding papers.

Figure 4:
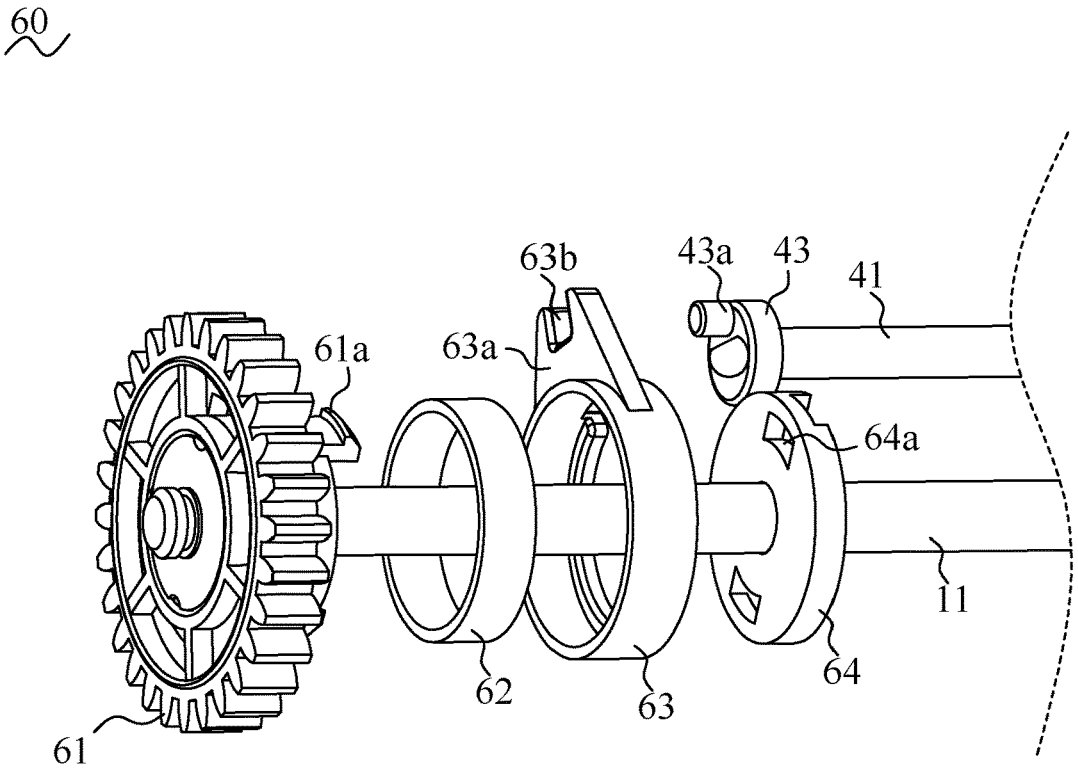
FIG. 4 is an exploded view of a torque-limiting mechanism of the paper blocking device in accordance with the preferred embodiment of the present invention.
Figure 5:
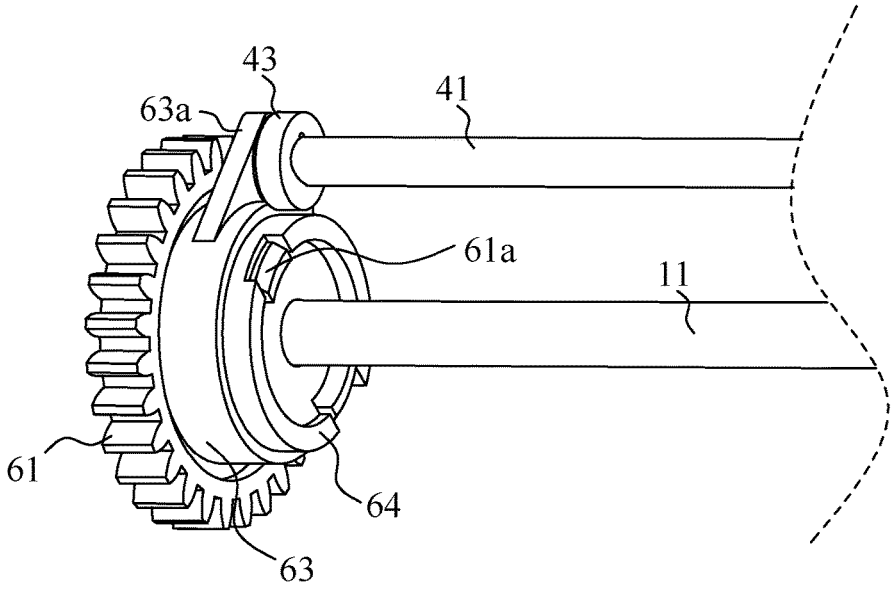
FIG. 5 is a perspective view of a torque-limiting mechanism of the paper blocking device in accordance with the preferred embodiment of the present invention.

With reference to FIG. 4-5, an engaged slot 63*b* is formed on the connection portion 63*a*. The other end of the driving shaft 41 which is adjacent to the torque-limiting mechanism 60 is sleeved on a connecting rod 43. The connecting rod 43 is extended toward the connecting portion 63*a* of the driving ring 63. An eccentric shaft 43*a* is located on the connecting rod 43, and the eccentric shaft 43*a* is engaged in the engaged slot 63*b*, so that the driving shaft 41 is driven by the eccentric shaft 43*a*, and the driving shaft 41 is rotated around the pick roller shaft 11.

As described above, the paper blocking device 100 can block papers and align the leading edges of papers. So the portable scanner with the paper blocking device 100 or the portable printer with the paper blocking device 100 is convenient to user.

With reference to FIG. 2-4 and FIG. 6, the paper blocking device 100 is located at an inlet of a document channel of the portable scanner in an used status. When the portable scanner is initialized, the motor 70 is rotated reversely, the engaged protrusion 42*a* is contacted with the arc shape recess 33 because the driving shaft 41 is rotated under drive of the gear mechanism 50. The blocking arms 32*a*, 32*b* are moved up because the cam 42 is rotated under drive of the driving shaft 41, so that the protrusion 34 is swung above the top surface of the pick roller 10 for blocking paper and aligning leading edges of papers. When scanning process is beginning, the motor 70 is rotated forward, and the engaged protrusion 42*a* of the cam 42 is rotated to leave the arc shape recess 33 of the paper blocking component 30 under drive of the gear mechanism 50. So the blocking arms 32*a*, 32*b* are swung below the top surface of the pick roller 10 for feeding papers, so that the scanning process can be continue. When the scanning process is finished, the motor 70 is rotated reversely again. The blocking arms 32*a*, 32*b* are swung up by the cam 42 again, and the protrusion 34 is swung above the top surface of the pick roller 10 again for blocking papers, so that the protrusion 34 can prevent papers from being manually inserted in the document channel of the portable scanner. In addition, if a feeding force is higher than a highest torque of the torque-limiting mechanism 60 in the feeding process, the driving ring 63 is slipped on the friction plate 64, and the driving shaft 41 is not rotated, so that the paper blocking device 100 is stop to prevent the components of the paper blocking device 100 from being damaged.

As described above, the paper blocking device can block papers and align the leading edges of papers. So the portable scanner with the paper blocking device or the portable printer with the paper blocking device is convenient to user.

What is claimed is:

1. A paper blocking device, comprising:

a pick roller;

a cover plate having a pick roller window penetrated through the cover plate, the pick roller being positioned in the pick roller window;

a paper blocking component coupled to the cover plate, one end of the paper blocking component being hinged on the cover plate, the other end of the paper blocking component being located in the pick roller window;

a driving mechanism having a driving shaft, and a cam, one end of the cam being connected to one end of the driving shaft, the other end of the cam being connected to the one end of the paper blocking component and being positioned under the one end of the paper blocking component;

a gear mechanism being connected to the other end of the driving shaft; and a motor being connected to the gear mechanism;

wherein, the other end of the paper blocking component moves above a top surface of pick roller or moves below the top surface of the pick roller by rotation of the cam under drive of the motor, the gear mechanism and the driving shaft, an engaged protrusion is extended from the cam, an arc shape recess is formed on a bottom surface of the paper blocking component, and the engaged protrusion is fitted with the arc shape recess.

2. The paper blocking device as claimed in claim 1, wherein one end of the paper blocking component has a linking portion being hinged on the cover plate, two blocking arms are located on two sides of the linking portion, the blocking arms are accommodated in the pick roller window, and the blocking arms are located on two sides of the pick roller.

3. The paper blocking device as claimed in claim 1, wherein a protrusion is extended from the other end of the paper blocking component, and the protrusion is extended toward the top surface of the pick roller.

4. The paper blocking device as claimed in claim 1, wherein a protrusion is extended from a free end portion of each of the blocking arms.

5. The paper blocking device as claimed in claim 1, wherein a pick roller shaft is connected to the pick roller, the pick roller shaft is connected to the motor by the gear mechanism, a torque-limiting mechanism is located between the driving shaft and the gear mechanism, the driving shaft and the pick roller shaft are parallel with each other, the torque-limiting mechanism has a driving gear, an elastic piece, a driving ring and a friction plate which are sleeved on the pick roller shaft in order, a connection portion extended from an outer surface of the driving ring is connected to the other end of the driving shaft, the friction plate is circular shape with an axle hole in a middle thereof, at least two engaged recesses are formed on the friction plate, at least two hooks corresponding to the engaged recesses are located on one end of the driving gear and face the elastic piece, the hooks are passed through the elastic piece, the driving ring and the friction plate in order, and the hooks are clamped with the engaged recesses, so that the elastic piece, the driving ring and the friction plate are assembled, the elastic piece is located between the driving gear and the driving ring, and the elastic piece applies a normal force toward the driving ring, so that a friction force is caused between the driving ring and the friction plate.

6. The paper blocking device as claimed in claim 5, wherein an engaged slot is formed on the connection portion, one end of the driving shaft is sleeved on a connecting rod, an eccentric shaft is located on the connecting rod, and the eccentric shaft is engaged with the engaged slot, so that the driving shaft is driven by the eccentric shaft, and the driving shaft is rotated around the pick roller shaft.

7. A paper blocking device, comprising:

a cover plate having a pick roller window penetrated through the cover plate;

a pick roller being positioned in the pick roller window;

a paper blocking component having a linking portion being hinged on the cover plate, and at least one blocking arm being connected to the linking portion and positioned in the pick roller window;

a driving mechanism having a driving shaft, and a cam, one end of the cam being connected to one end of the driving shaft, the other end of the cam being connected to the at least one blocking arm and being positioned under the at least one blocking arm;

a gear mechanism being connected to the other end of the driving shaft; and a motor being connected to the gear mechanism;

wherein, the at least one blocking arm moves above a top surface of pick roller or moves below the top surface of the pick roller by rotation of the cam under drive of the motor, the gear mechanism and the driving shaft, an engaged protrusion is extended from the cam, an arc shape recess is formed on a bottom surface of the paper blocking component, and the engaged protrusion is fitted with the arc shape recess.

8. The paper blocking device as claimed in claim 7, wherein a protrusion is extended from the at least one blocking arm, and the protrusion is extended toward the top surface of the pick roller.

9. The paper blocking device as claimed in claim 7, wherein a protrusion is extended from a free end portion of the at least one blocking arm.

10. The paper blocking device as claimed in claim 7, wherein a pick roller shaft is connected to the pick roller, the pick roller shaft is connected to the motor by the gear mechanism, a torque-limiting mechanism is located between the driving shaft and the gear mechanism, the driving shaft and the pick roller shaft are parallel with each other, the torque-limiting mechanism has a driving gear, an elastic piece, a driving ring and a friction plate which are sleeved on the pick roller shaft in order, a connection portion extended from an outer surface of the driving ring is connected to the other end of the driving shaft, the friction plate is circular shape with an axle hole in a middle thereof, at least two engaged recesses are formed on the friction plate, at least two hooks corresponding to the engaged recesses are located on one end of the driving gear and face the elastic piece, the hooks are passed through the elastic piece, the driving ring and the friction plate in order, and the hooks are clamped with the engaged recesses, so that the elastic piece, the driving ring and the friction plate are assembled, the elastic piece is located between the driving gear and the driving ring, and the elastic piece applies a normal force toward the driving ring, so that a friction force is caused between the driving ring and the friction plate.

11. The paper blocking device as claimed in claim 10, wherein an engaged slot is formed on the connection portion, one end of the driving shaft is sleeved on a connecting rod, an eccentric shaft is located on the connecting rod, and the eccentric shaft is engaged with the engaged slot, so that the driving shaft is driven by the eccentric shaft, and the driving shaft is rotated around the pick roller shaft.

* * * * *